US008532318B2

(12) United States Patent
Isozaki et al.

(10) Patent No.: US 8,532,318 B2
(45) Date of Patent: Sep. 10, 2013

(54) HEARING AID DEVICE

(75) Inventors: Hiroyoshi Isozaki, Ehime (JP); Hiroshi Kondo, Ehime (JP); Nobuaki Noguchi, Ehime (JP); Hirotaka Ochi, Ehime (JP)

(73) Assignee: Panasonic Corporation, Osaka (JP)

( * ) Notice: Subject to any disclaimer, the term of this patent is extended or adjusted under 35 U.S.C. 154(b) by 109 days.

(21) Appl. No.: 13/121,522

(22) PCT Filed: Oct. 5, 2010

(86) PCT No.: PCT/JP2010/005966

§ 371 (c)(1),
(2), (4) Date: Mar. 29, 2011

(87) PCT Pub. No.: WO2011/045905

PCT Pub. Date: Apr. 21, 2011

(65) Prior Publication Data

US 2011/0261982 A1 Oct. 27, 2011

(30) Foreign Application Priority Data

Oct. 13, 2009 (JP) ..... 2009-236388

(51) Int. Cl.
*H04R 25/00* (2006.01)

(52) U.S. Cl.
USPC ..... 381/315; 381/312

(58) Field of Classification Search
USPC ..... 381/312, 315, 23.1, 314, 320, 321; 600/25
See application file for complete search history.

(56) References Cited

U.S. PATENT DOCUMENTS

| | | | | |
|---|---|---|---|---|
| 5,721,783 | A | 2/1998 | Anderson | |
| 7,773,763 | B2 | 8/2010 | Pedersen | |
| 2002/0159613 | A1 * | 10/2002 | Killion | 381/323 |
| 2007/0291969 | A1 | 12/2007 | Tateno et al. | |
| 2008/0212810 | A1 | 9/2008 | Pedersen | |
| 2010/0019920 | A1 * | 1/2010 | Ketari | 340/686.6 |
| 2010/0027822 | A1 * | 2/2010 | Dietz | 381/315 |

FOREIGN PATENT DOCUMENTS

| | | | |
|---|---|---|---|
| AU | 2008202727 | A1 | 1/2009 |
| AU | 2008202727 | B2 | 1/2009 |
| CA | 2212131 | | 2/1998 |
| EP | 0 823 829 | A2 | 2/1998 |
| EP | 0 823 829 | A3 | 1/2000 |
| JP | 10-126895 | | 5/1998 |
| JP | 11-511301 | | 9/1999 |
| JP | 2006-303672 | | 11/2006 |
| JP | 2007-507119 | | 3/2007 |
| JP | 2007-336308 | | 12/2007 |
| JP | 2008-42508 | | 2/2008 |
| JP | 2009-17557 | | 1/2009 |

* cited by examiner

*Primary Examiner* — Curtis Kuntz
*Assistant Examiner* — Joshua Kaufman
(74) *Attorney, Agent, or Firm* — Wenderoth, Lind & Ponack, L.L.P.

(57) ABSTRACT

With the hearing aid device of the present invention, when the power is turned on, communication starts between the first and second hearing aids, and until this communication is established, it is recognized that the power has not been switched on to the second hearing aid, and the user is notified. Also, if the battery of the second hearing aid should die during use, a dead battery notification is sent to the first hearing aid, and if communication between the first and second hearing aids is blocked, the user is notified on the side of the first hearing aid that is operating.

10 Claims, 6 Drawing Sheets

(a)

(b)

(a)

(b)

HEARING AID DEVICE

TECHNICAL FIELD

The present invention relates to a hearing aid device in which two hearing aids used on the two ears communicate with each other.

BACKGROUND ART

Binaural type of hearing aid that has been gaining popularity in recent years is mounted on both ears, and various modes are synchronized between the hearing aids through wireless communication.

However, it is possible that these hearing aids will end up in a state in which they cannot communicate with each other due to malfunction, communication interference, or some other such problem. Therefore, techniques have been disclosed with which there is no cooperation between the two ears if this happens, and the hearing aid device operates at just one ear (see Patent Literature 1, for example).

CITATION LIST

Patent Literature

Patent Literature 1: Japanese Laid-Open Patent Application 2007-336308

SUMMARY

Nevertheless, the following problems were encountered with the technique disclosed in the above-mentioned publication.

Usually, when a binaural type of hearing aid is used, the power must be switched on to each of the hearing aids, but it may happen that the user turns on one power switch but forgets to turn on the power switch to the other hearing aid. In this case, the user must realize that he has forgotten to turn on the power after putting the hearing aid on the ear, then remove that hearing aid, turn on the power, and then put the hearing aid back on again, so this system is not very convenient.

Also, with a conventional hearing aid, there is the risk that the user will keep using the hearing aid without realizing that he has forgotten to turn on the power, or that he will keep using it without recognizing that a battery has died in one of the hearing aids during use. This is because when the hearing aid is not operating, it is hard for the user simply to recognize that "it was hard to hear," and to recognize that a battery is dead or that he has forgotten to turn on the power. This problem is particularly likely to occur with open-type hearing aids.

The technique disclosed in the above-mentioned publication is for operating with just one hearing aid when communication cannot be established. Therefore, the user cannot be notified of a malfunction in one of the hearing aids, and the problem of inconvenience cannot be solved.

In view of this, it is an object of the present invention to provide a convenient binaural type of hearing aid device with which the user can be reliably advised that the power has been properly switched on to both hearing aids, and that the power to one hearing aid has been blocked due to a low battery during use.

To achieve this object, the hearing aid device of the present invention comprises first and second hearing aids separately mounted on the two ears of the user. The first and second hearing aids each have a main body, a sound collector, a hearing aid processor, a speech output section, a communication section, a notification controller, and a notification synthesizer. The main body has a mounting shape that conforms to the shape of the user's ear. The sound collector takes in ambient sound from around the main body. The hearing aid processor subjects the ambient sound taken in by the sound collector to hearing aid processing. The speech output section outputs to outside the main body the sound that has been processed by the hearing aid processor. The communication section communicates between the first and second hearing aids. The notification controller decides the communication state between the first and second hearing aids. The notification synthesizer that alerts the user according to the decision result for the communication state by the notification controller.

Furthermore, the hearing aid device of the present invention comprises first and second hearing aids separately mounted on the two ears of the user. The first and second hearing aids each have a main body, a sound collector, a hearing aid processor, a speech output section, a communication section, a remaining battery charge transmission section, a notification controller, and a notification synthesizer. The main body has a mounting shape that conforms to the shape of the user's ear. The sound collector that takes in ambient sound from around the main body. The hearing aid processor subjects the ambient sound taken in by the sound collector to hearing aid processing. The speech output section outputs to outside the main body the sound that has been processed by the hearing aid processor. The communication section communicates between the first and second hearing aids. The remaining battery charge transmission section notifies the first or the second hearing aid that the battery has died in the second or the first hearing aid. The notification controller determines the communication state between the first and second hearing aids and the state of the remaining battery charge of the first and second hearing aids. The notification synthesizer alerts the user to the determination result for the communication state by the notification controller, and at the first or the second hearing aid whose battery has not died according, on the basis of the determination result for the remaining battery charge of the second or first hearing aid.

ADVANTAGEOUS EFFECTS

With the hearing aid device of the present invention, a convenient hearing aid device can be provided because the user can be reliably advised that the power has been properly switched on to both hearing aids, and that the power to one hearing aid has been blocked due to a low battery during use.

DESCRIPTION OF EMBODIMENTS

Embodiments of the hearing aid device of the present invention will now be described along with the drawings. In the following description, the hearing aid on the side where the battery is not dead will be called the first hearing aid, and the hearing aid on the side with the dead battery will be called the second hearing aid, but it should go without saying that the same effect will be obtained if the two are switched around.

Embodiment 1

Figure 1:
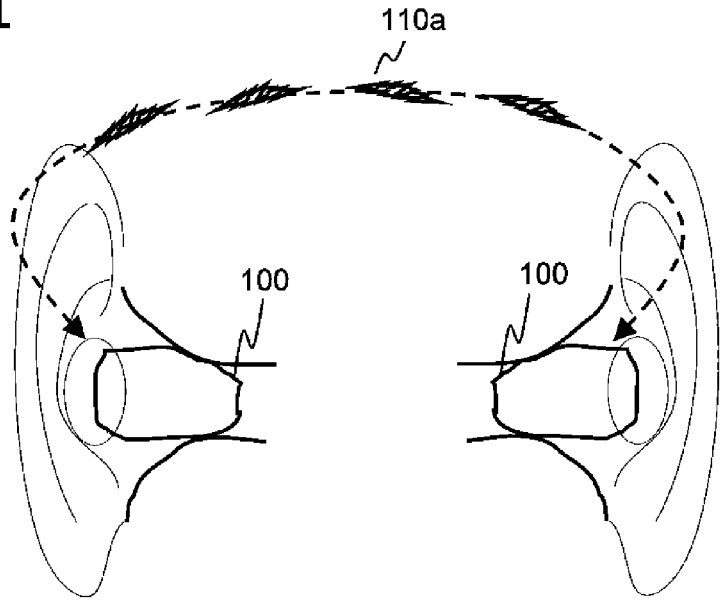
FIG. 1 is a diagram of the configuration of the hearing aid device pertaining to Embodiment 1 of the present invention.
Figure 1:
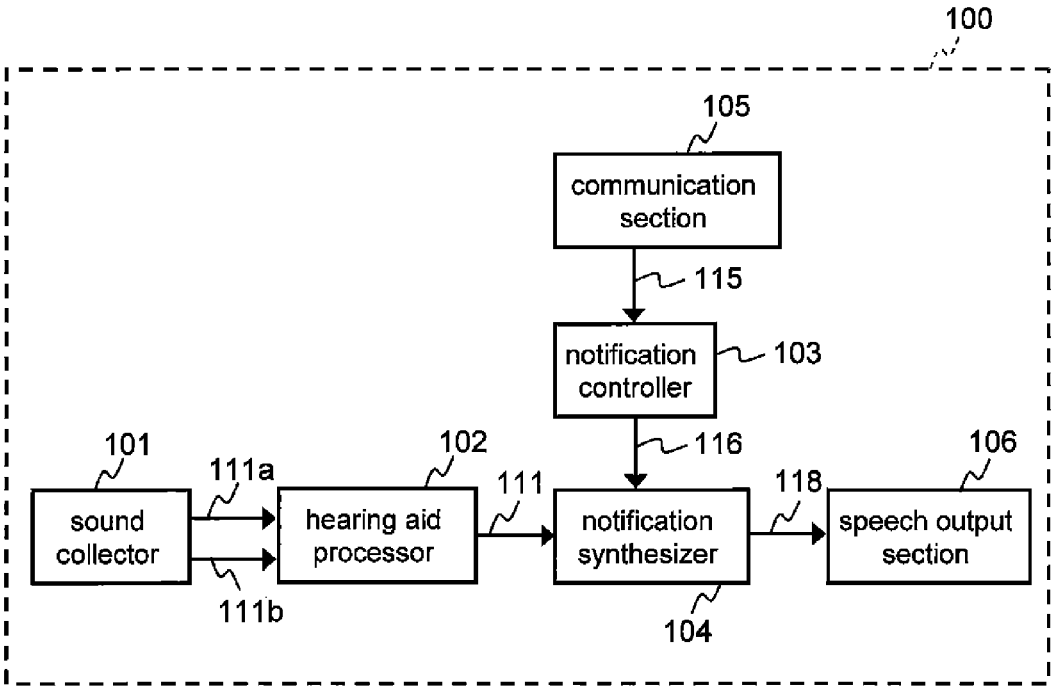

FIG. 1 shows the configuration of the hearing aid device in this embodiment. FIG. 1*a* is a concept diagram of when the two hearing aids 100 (first and second hearing aids) constituting the hearing aid device have been mounted to the ears. FIG. 1*b* is a block diagram of the configuration of the hearing aids 100.

As shown in FIG. 1, the hearing aid device in this embodiment comprises the two hearing aids 100, 100, which are mounted one each on the two ears.

As shown in FIG. 1*b*, each hearing aid 100 has a sound collector 101, a hearing aid processor 102, a notification controller 103, a notification synthesizer 104, a communication section 105, and a speech output section 106. Here, the two hearing aids 100, 100 have exactly the same configuration, and are in a completely equal relationship, with neither being inferior to the other. As shown in FIG. 1*a*, the hearing aids 100, 100 are constantly exchanging signals with each other via wireless radio waves 110*a*.

The various elements shown in FIG. 1*b* will now be described in detail.

The sound collector 101 includes a sound hole (not shown) provided to the main body of the hearing aid 100, and a microphone (not shown) that collects ambient sound that comes in through the sound hole. The microphone converts the collected acoustic signals into analog electrical signals and outputs them. In this embodiment, the sound collectors 101 are provided with two pairs of sound hole and microphone in order to have directionality, and each output an analog input signal 111*a* and an analog input signal 111*b*.

The hearing aid processors 102 subject the analog input signals 111*a* and 111*b* outputted from the sound collectors 101 to hearing aid processing, and adjust the volume to suit the hearing characteristics of the user, after which the products are outputted as analog hearing aid signals 111 to the notification synthesizers 104.

Figure 2:
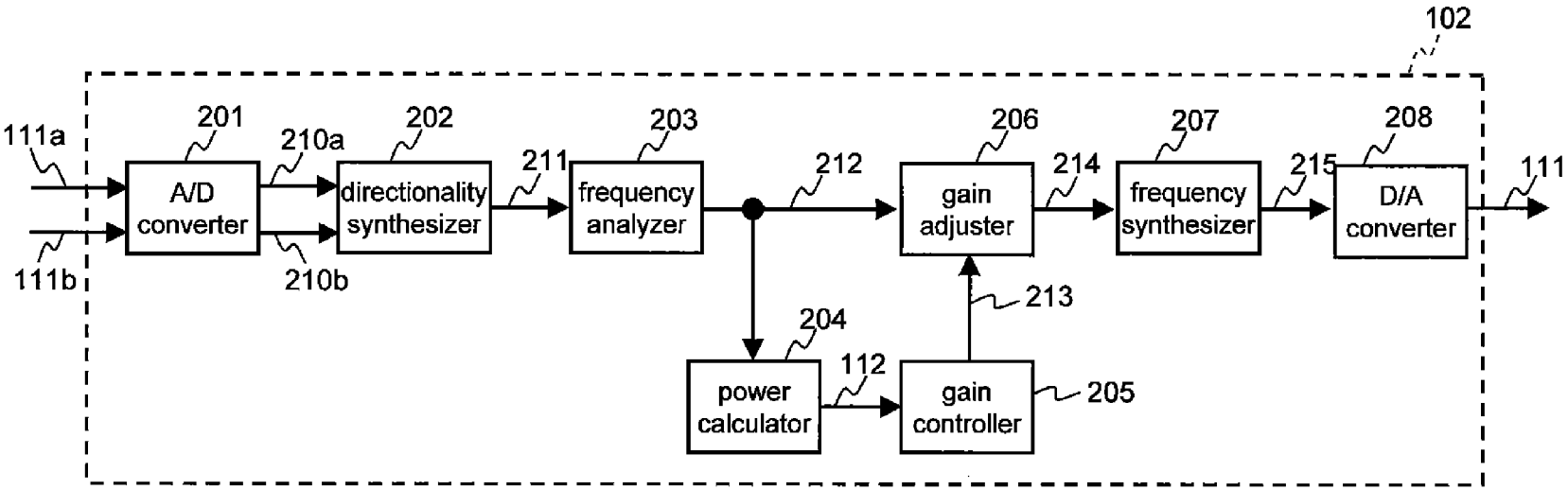
FIG. 2 is a block diagram of the hearing aid processor included in the hearing aid device in FIG. 1.

The hearing aid processor 102 will now be described in detail through reference to FIG. 2. FIG. 2 is a block diagram of the hearing aid processor 102.

As shown in FIG. 2, the hearing aid processor 102 includes an A/D (analog to digital) converter 201, a directionality synthesizer 202, a frequency analyzer 203, a power calculator 204, a gain controller 205, a gain adjuster 206, a frequency synthesizer 207, and a D/A (digital to analog) converter 208.

The A/D converters 201 digitally sample the analog input signals 111*a* and 111*b* outputted from the sound collectors 101, and output the products as digital input signals 210*a* and 210*b* to the directionality synthesizers 202.

The directionality synthesizers 202 magnify sound coming from a specific direction with respect to the user, and reduce sound from other directions. Specifically, they process and synthesize the digital input signals 210*a* and 210*b* so as to match the directionality of the hearing aids 100 in a specific direction. The synthesized signal is outputted as a synthesized signal 211 to the frequency analyzers 203. The directionality synthesizers 202 have a plurality of adaptive filters and adders, and by varying the computation coefficients thereof, it is possible to match the directionality to a desired orientation, or to achieve a non-directional state in which the sound can be heard equally in all directions.

The frequency analyzers 203 convert the synthesized signal 211 inputted in time series from signals for a time region into signals for a frequency region, divide these into a plurality of frequency bands, and output them as a frequency signal group 212. Methods that can be employed to this end include dividing the result of Fourier transformation, and a sub-band division method.

This division is performed by splitting the frequency handled by the hearing aids 100, 100 into a plurality of segments from the upper limit to the lower limit. For example, if the hearing aids 100, 100 handle ten channels (or ten bands), the frequency region is divided in ten by the frequency analyzers 203. The frequency signals are outputted for each of the frequency bands. The frequency analyzers 203 output these ten frequency signals as the frequency signal group 212.

The power calculators 204 calculate the power level for each frequency signal of the various bands of the frequency signal group 212 outputted from the frequency analyzers 203. The term "power level" here is the magnitude of the electrical power of the signals inputted to the frequency analyzers 203, and is correlated with the sound pressure level of the acoustic signals inputted to the sound collectors 101. Specifically, the lower is the sound pressure level inputted to the sound collectors 101, the higher is the power level, and the higher is the sound pressure level, the lower is the power level. The power level is found by taking the sum of squares for the real number section and the imaginary number section for every frequency signal in each band. The power level calculated for each band is outputted as a power level group 112 to the gain controllers 205.

The gain controllers 205 decide the gain with respect to the frequency signal for each band on the basis of the power level group 112. A gain table is used to decide the gain. The dynamic range of hearing varies from one user to the next, and nonlinear gain adjustment suited to a given user is necessary for the sound pressure level of an inputted acoustic signal. In view of this, with the hearing aid device of this embodiment, a gain table is produced that sets out the gain characteristics required for the user, which have been found ahead of time by audiogram or the like, for every inputted sound pressure level, that is, power level. The gain controllers 205 comprise this gain table for all frequency bands, and the corresponding gain is decided by referring to a gain table when the power level group 112 is inputted. These values are outputted as a gain control signal group 213 to the gain adjusters 206.

The gain adjusters 206 perform gain computation for the frequency signal group 212, which is a group of frequency signals for each band, on the basis of the gain control signal group 213, and perform gain adjustment on the frequency signals. The frequency signals that have undergone gain adjustment are outputted as an adjusted frequency signal group 214 to the frequency synthesizers 207.

The frequency synthesizers 207 combine the adjusted frequency signal groups 214 composed of ten divided frequency signals and convert from signals for a frequency region into signals for a time region. The frequency synthesis is accomplished, for example by reverse Fourier transformation when the frequency analysis is Fourier transformation, and by sub-band synthesis when it is sub-band division. The signals that have undergone frequency synthesis are outputted as digital hearing aid signals 215 to the D/A (digital to analog) converters 208.

The D/A converters 208 perform the reverse conversion from that of the A/D converters 201, and convert the digital hearing aid signals 215, which are digital signals, into the hearing aid signals 111, which are analog signals.

Figure 3:
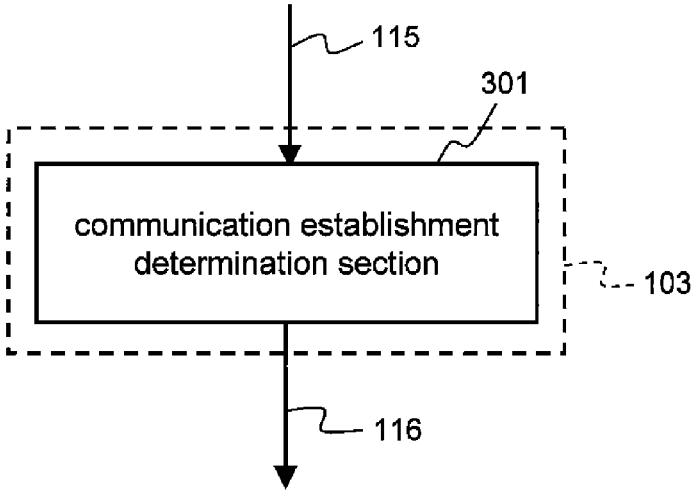
FIG. 3 is a block diagram of the notification controller included in the hearing aid device in FIG. 1.
Figure 5:
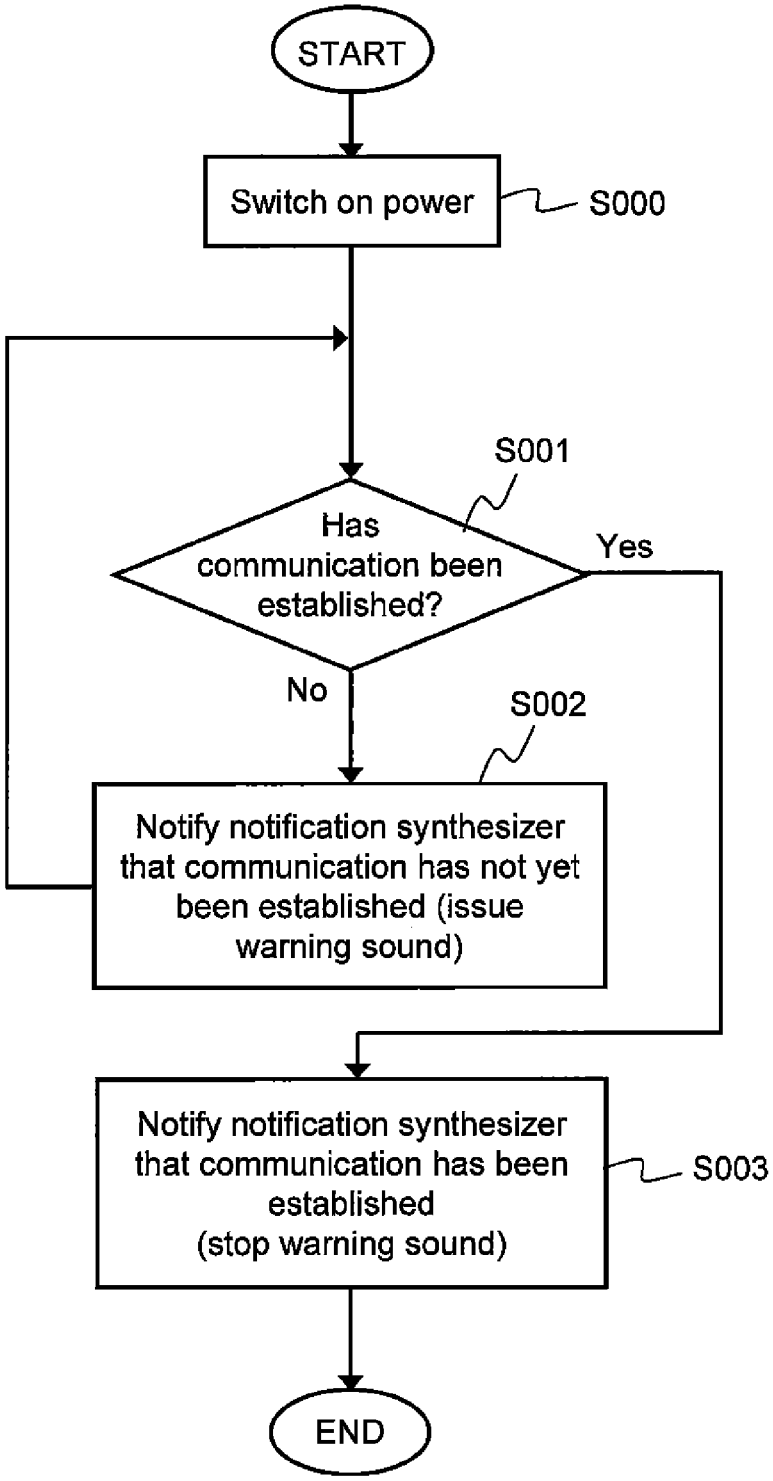
FIG. 5 is a flowchart of the operation of the notification controller included in the hearing aid device of FIG. 1.

Next, the notification controller 103 will be described in detail through reference to FIGS. 3 and 5. FIG. 3 is a block diagram of the notification controller 103. The notification controller 103 shown in FIG. 3 includes a communication establishment determination section 301. FIG. 5 is a flowchart of the flow of processing of the communication section 105.

First, as shown in FIG. 5, when the power is turned on to the hearing aids 100, 100 (S000), various initializations are performed, and the operation of the hearing aids 100, 100 begins.

After this, the communication section 105 of one of the hearing aids (the first hearing aid) 100 attempts to make a communication connection to begin communication with the communication section 105 of the other hearing aid (the second hearing aid) 100. At this point, communication section 105 of the first hearing aid 100 notifies the communication establishment determination section 301 of the current communication establishment situation in the form of a communication status signal 115.

The communication establishment determination section 301 monitors the establishment of this communication connection (S001), and if communication has yet to be established, a signal of "0," which indicates that communication has yet to be established, is sent to the notification synthesizer 104 (S002). Upon receiving this notification, the notification synthesizer 104 generates a warning sound.

On the other hand, if communication has been established, the communication establishment determination section 301 sends a signal of "1," which indicates that communication has been established, as a notification to the notification synthesizer 104 (S003). Upon receiving this notification, the notification synthesizer 104 stops the warning sound.

In the flowchart of FIG. 5, if it is first determined in S001 that communication has not been established, then in S002 a warning sound is generated, but this is not the only option. For example, a step in which iterations are counted by a counter may be provided in between S001 and S002, and a warning sound generated only when the count of times when it is determined that communication has not been established exceeds a specific count. If this is done, it avoids accidental generation of a warning sound in events such as when the power is on to the second hearing aid 100, but the communication status just happens to be poor, and radio waves cannot be received form the first hearing aid 100. As a result, a warning sound can be generated only in cases when a warning is really necessary.

Figure 4:
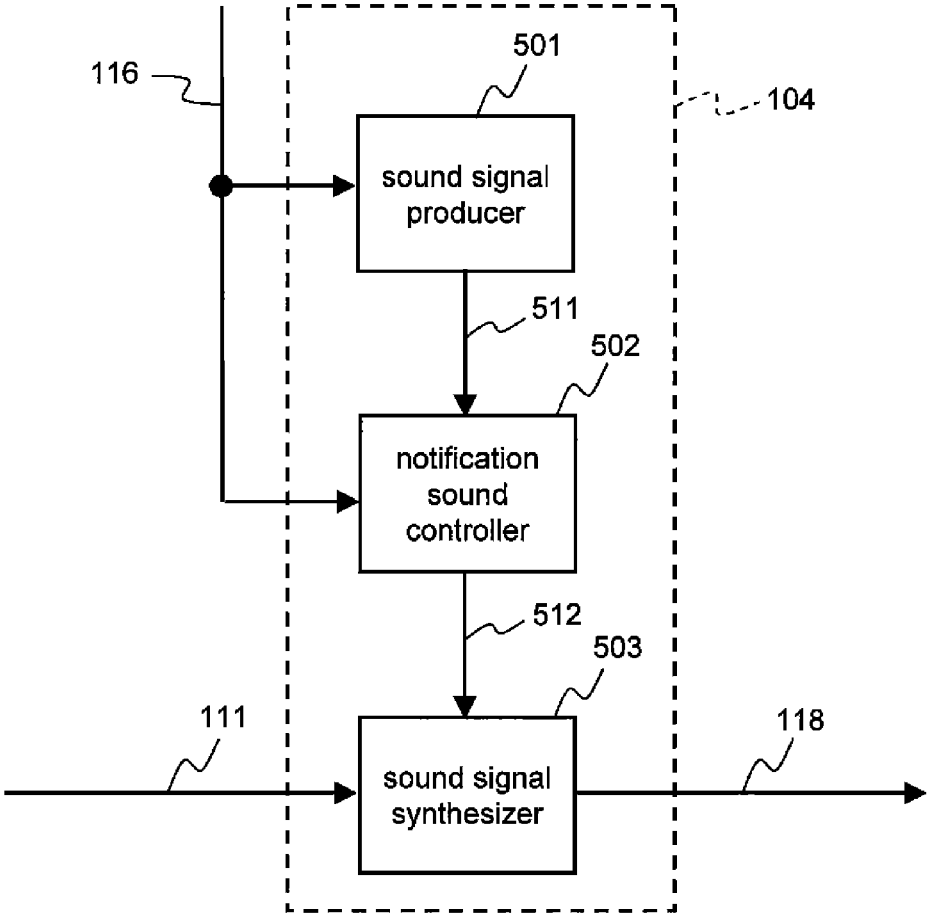
FIG. 4 is a block diagram of the notification synthesizer included in the hearing aid device in FIG. 1.

Next, the notification synthesizer 104 will be described through reference to FIG. 4. FIG. 4 is a block diagram of the notification synthesizer 104. The notification synthesizer 104 has a sound signal producer 501, a notification sound controller 502, and a sound signal synthesizer 503.

The sound signal producer 501 produces a specific sound upon receipt of a signal of "0" as the communication establishment signal 116, that is, when notified that communication has yet to be established. The term "specific sound" here is a beeping sound that is repeated at a short interval. The sound signal producer 501 outputs this specific sound as a specific sound signal 511 to the notification sound controller 502. In this embodiment, the specific sound signal 511 is an analog signal.

The notification sound controller 502 outputs the specific sound signal 511 outputted from the sound signal producer 501, as a notification sound signal 512 to the sound signal synthesizer 503 upon receipt of a signal of "0" as the communication establishment signal 116.

On the other hand, when a signal of "1" is received as the communication establishment signal 116, that is, when communication has been established, the sound signal producer 501 ends the production of sound. The notification sound controller 502 then stops the output of the notification sound signal 512.

The sound signal synthesizer 503 uses a multiplier to superimpose the hearing aid signal 111 outputted from the hearing aid processor 102 and the notification sound signal 512 outputted from the notification sound controller 502, and outputs the result as a synthesized hearing aid signal 118 to the speech output section 106.

If a warning sound is emitted for a certain length of time, it is conceivable that the user will not recognize that the power has not been turned on, so if a specific length of time has elapsed without communication being established, the sound signal producer 501 may end the production of the specific sound signal 511.

As discussed above, with the hearing aid device of this embodiment (the first and second hearing aids 100, 100), the user can be reliably notified of whether or not the power has been turned on to the first and second hearing aids 100, 100. Accordingly, if necessary, the user can be reliably instructed to replace the battery. As a result, the user is prevented from continuing to use the hearing aid device when a battery is dead, which means that a hearing aid device can be provided which is more convenient to use than in the past.

Embodiment 2

Figure 6:
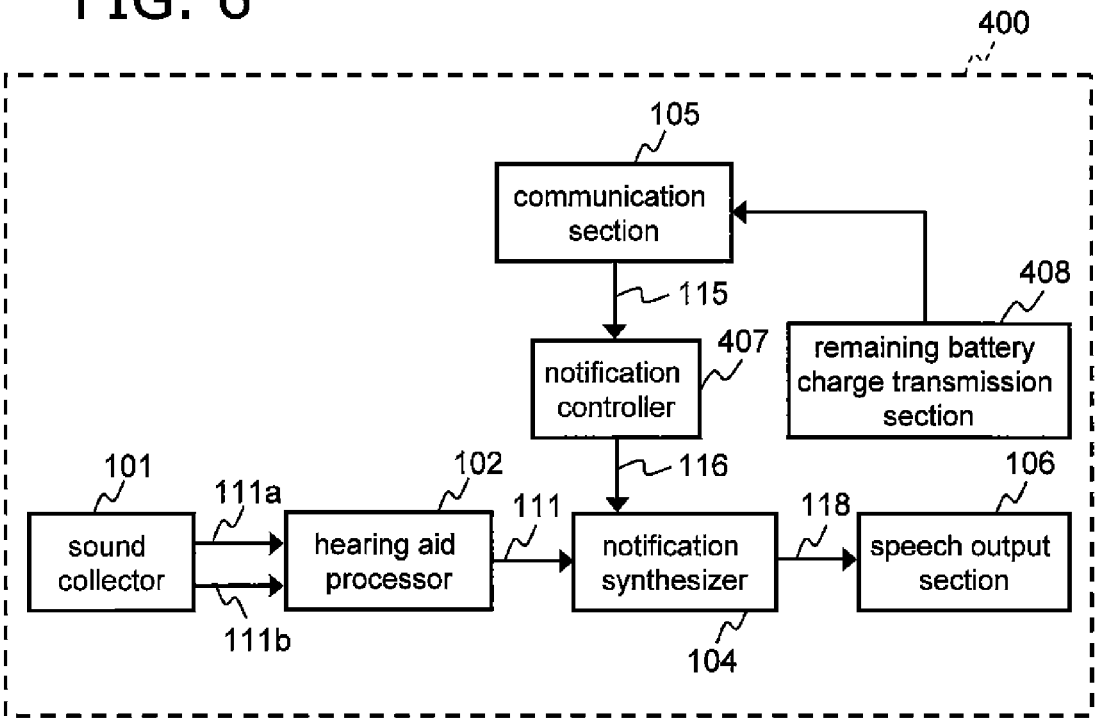
FIG. 6 is a block diagram of the hearing aid device pertaining to another embodiment of the present invention.

FIG. 6 is a block diagram of the configuration of a pair of (left and right) first and second hearing aids 400, 400 included in the hearing aid device pertaining to another embodiment of the present invention.

This embodiment, as shown in FIG. 6, differs from Embodiment 1 above in that notification controller 407 and a remaining battery charge transmission section 408 are added, but the rest of the configuration and operation are the same as in Embodiment 1, so those sections will be numbered the same and not described again.

Figure 7:
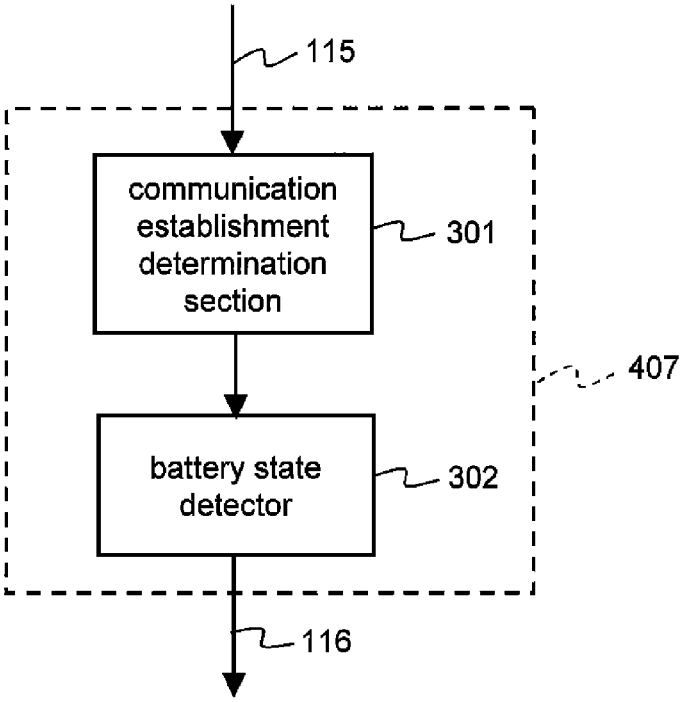
FIG. 7 is a block diagram of the notification controller included in the hearing aid device in FIG. 6.

FIG. 7 is a block diagram of the configuration of the notification controller 407. The difference between the notification controller 407 and the notification controller 103 in Embodiment 1 above is that a battery state detector 302 is added.

If the battery should start to die and the power drop off in the second hearing aid 400 while the first and second hearing aids 400, 400 are both in use, the second hearing aid 400, which is the one that has stopped functioning due to a dead battery, emits a warning sound itself. At the same time, the second hearing aid 400 that has stopped functioning sends the first hearing aid 400 a function stop signal 117 from the remaining battery charge transmission section 408 to the effect that its function has stopped due to battery failure.

After the first hearing aid 400 that still has a battery charge has received the function stop signal 117, the battery state detector 302 recognizes that the second hearing aid 400 is in a dead battery state. After this, if the second hearing aid 400 has actually stopped functioning because of a dead battery, the first hearing aid 400 recognizes that communication has been blocked by the communication establishment determination section 301, and concludes from this information that power to the second hearing aid 400 has actually been blocked due to a dead battery.

Once it has been decided that the second hearing aid 400 has stopped functioning due to a dead battery, the first hearing aid 400 periodically sends a communication establishment signal 116 to the notification synthesizer 104, and the notification synthesizer 104 emits a warning sound, until the communication establishment determination section 301 recognizes that communication has once again been established.

Figure 8:
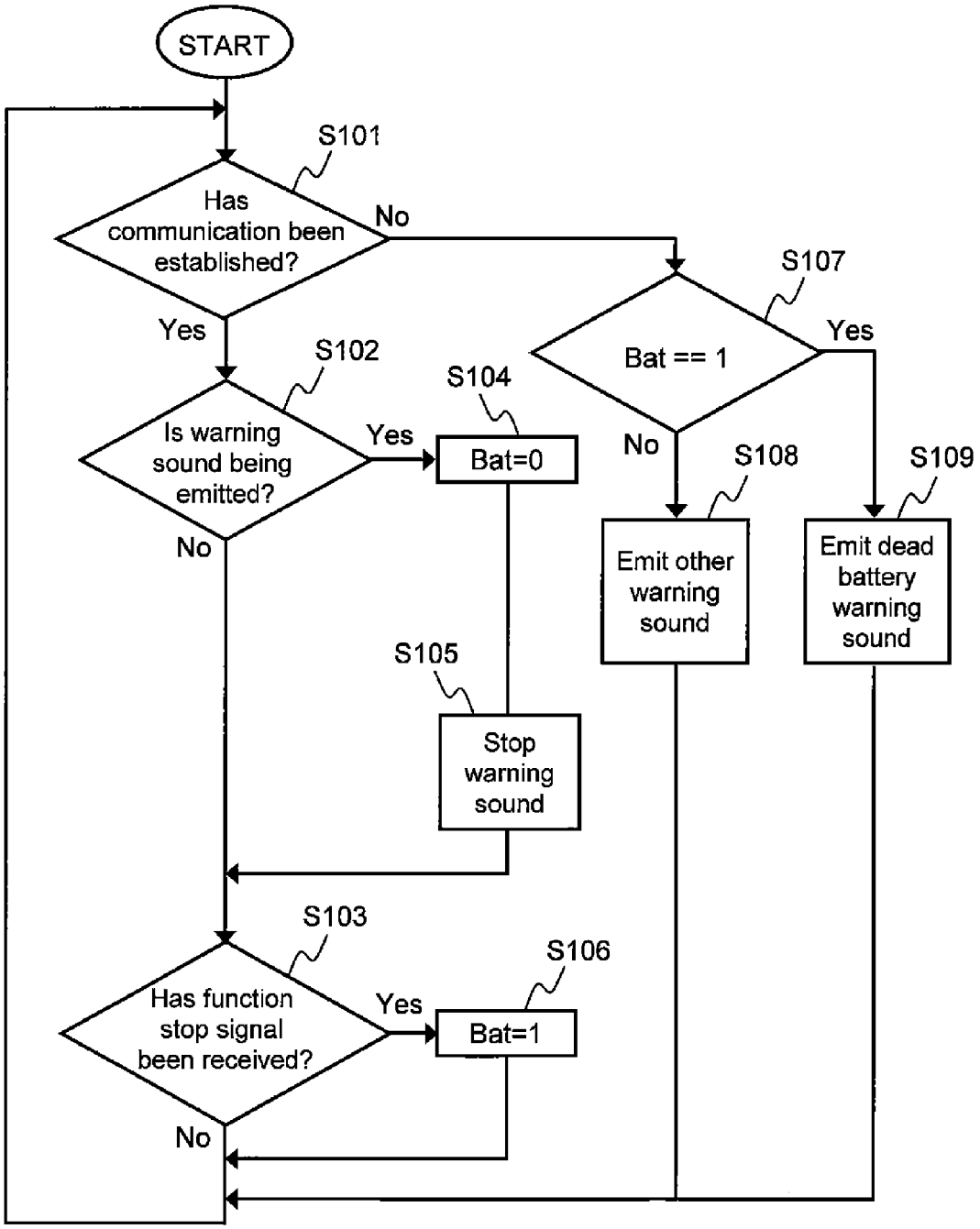
FIG. 8 is a flowchart of the operation of the notification controller in FIG. 7.

FIG. 8 is a flowchart of the flow of processing by the notification controller 407.

First, whether or not communication has been established between the first and second hearing aids 400, 400 is checked (S101). Possible reasons for communication not having been established are when the battery of the second hearing aid 400 is dead, and when communication is impossible due to some other communication interruption, and the reason here is identified (S107).

Whether or not the battery of the second hearing aid 400 is dead is decided from a signal stored in a variance Bat. For example, if the variable Bat is "0," there is some other communication interruption, but if the variable Bat is "1," this means the battery is dead. If the battery is dead (Bat=1), the notification controller 407 emits a warning sound indicating that the battery is dead (S109), and if there is some other communication interruption (Bat=0), a warning sound that is different from that used for a dead battery is emitted (S108).

Here, if the notification controller 407 has decided in S101 that communication has been established, then whether or not a warning sound is being emitted is confirmed (S102). The purpose of this is to decide whether or not the communication state has been restored after a communication interruption.

If a warning sound is being emitted, it can be concluded that communication has been restored, in which case the notification controller 407 initializes the variable Bat to "0" (S104). This is because if the initial value of the variable Bat is set to "0," then if a communication interruption should suddenly occur in the future, it can be recognized as being caused by some kind of problem. After the variable Bat has been set to an initial value of "0," the warning sound is stopped (S105).

Next, the notification controller 407 confirms whether or not the function stop signal 117 has been received via the communication section 105 (S103). If a function stop signal has been received, the notification controller 407 sets the variable Bat to "1" (S106). Consequently, if a communication interruption should occur subsequently, it can be recognized that the second hearing aid 400 has a dead battery.

This warning sound may be a constant sound, or it may be a periodic sound, such as one that is emitted every 10 minutes. Also, the notification controller 407 may not emit a warning sound if it has been decided that there is some other communication interruption (Bat=0) (S108).

As discussed above, with the hearing aid device of this embodiment, even if the second hearing aid 400 should stop functioning during its use due to a dead battery, the fact that the second hearing aid 400 side is in a dead battery state is conveyed to the first hearing aid 400, which periodically emits a warning sound to reliably alert the user to the dead battery. As a result, the user will not just keep using the second hearing aid 400 that has stopped functioning because of a dead battery, and will instead be sure to replace the battery, so a hearing aid device that is more convenient to use can be provided.

INDUSTRIAL APPLICABILITY

The hearing aid device pertaining to the present invention reliably ensures that the power is properly switched on to first and second hearing aids, and notifies the user when one of the hearing aids has stopped function due to a dead battery, and is therefore useful as a binaural type of hearing aid that is more convenient to use.

REFERENCE SIGNS LIST

100, 100 hearing aid (first and second hearing aids)
110*a* wireless radio wave
101 sound collector
102 hearing aid processor
103 notification controller
104 notification synthesizer
105 communication section
106 speech output section
111 analog hearing aid signal
111*a*, 111*b* analog input signal
112 power level group
115 communication status signal
116 communication establishment signal
117 function stop signal
118 synthesized hearing aid signal
201 A/D converter
202 directionality synthesizer
203 frequency analyzer
204 power calculator
205 gain controller
206 gain adjuster
207 frequency synthesizer
208 D/A converter
210*a*, 210*b* digital input signal
211 synthesized signal
212 frequency signal group
213 gain control signal group
214 adjusted frequency signal group
215 digital hearing aid signal
301 communication establishment determination section
302 battery state detector
400 hearing aid (first and second hearing aids)
407 notification controller
408 remaining battery charge transmission section
501 sound signal producer
502 notification sound controller
503 sound signal synthesizer
511 specific sound signal
512 notification sound signal

The invention claimed is:

1. A hearing aid device, comprising first and second hearing aids separately mounted on the two ears of the user, wherein the first and second hearing aids each have:

a main body having a mounting shape that conforms to the shape of the user's ear;

a sound collector that takes in ambient sound from around the main body;

a hearing aid processor that subjects the ambient sound taken in by the sound collector to hearing aid processing;

a speech output section that outputs to outside the main body the sound that has been processed by the hearing aid processor;

a communication section that communicates between the first and second hearing aids;

a notification controller that decides a communication state between the first and second hearing aids; and a counter that counts a number of times that the notification controller decides that communication has not been established between the first and second hearing aids; and a notification synthesizer that alerts the user that the power has not been turned on according to the decision result for the communication state by the notification controller when the number of times that the notification controller decides that the communication has not been established between the first and second hearing aids counted by the counter exceeds a specific count.

2. The hearing aid device according to claim 1, wherein the notification controller includes a communication establishment determination section that decides whether or not communication has been established between the first and second hearing aids.

3. The hearing aid device according to claim 2, wherein the communication establishment determination section sends the notification synthesizer a notification to issue a warning when it has been recognized that communication has not been established between the first and second hearing aids after the power has been turned on to the first hearing aid.

4. The hearing aid device according to claim 2, wherein the communication establishment determination section stops notification to the notification synthesizer if it is recognized that communication has been established between the first and second hearing aids after the power has been turned on to the first hearing aid.

5. The hearing aid device according to claim 1, wherein the notification synthesizer issues a warning when it is decided by the notification controller that communication has not been established.

6. A hearing aid device, comprising first and second hearing aids separately mounted on the two ears of the user, wherein the first and second hearing aids each have:

a main body having a mounting shape that conforms to the shape of the user's ear;

a sound collector that takes in ambient sound from around the main body;

a hearing aid processor that subjects the ambient sound taken in by the sound collector to hearing aid processing;

a speech output section that outputs to outside the main body the sound that has been processed by the hearing aid processor;

a communication section that communicates between the first and second hearing aids;

a remaining battery charge transmission section that notifies the first or the second hearing aid that the battery has died in the second or the first hearing aid;

a notification controller that determines a communication state between the first and second hearing aids and the state of the remaining battery charge of the first and second hearing aids; and a notification synthesizer that alerts the user that the battery of the first or the second hearing aid is dead at the first or the second hearing aid whose battery has not died according to the determination result for the communication state by the notification controller and on the basis of the determination result for the remaining battery charge of the first or second hearing aid, wherein the notification synthesizer alerts the user that the battery of the first or the second hearing aid is dead at the first or the second hearing aid whose battery has not died by emitting a warning sound that is different from a warning sound that is emitted for some other communication interruption between the first and second hearing aids.

7. The hearing aid device according to claim 6, wherein the notification controller has a communication establishment determination section that decides whether or not communication has been established between the first and second hearing aids, and a battery state detector configured to recognize a notification signal sent from the remaining battery charge transmission section of the second hearing aid.

8. The hearing aid device according to claim 7, wherein the notification controller notifies the notification synthesizer when the battery state detector recognizes a dead battery state of the second hearing aid and the communication establishment determination section decides communication between the first and second hearing aids has been blocked.

9. The hearing aid device according to claim 7, wherein the notification controller stops notification to the notification synthesizer when communication is restarted by the communication establishment determination section after a notification has issued by the notification synthesizer and a warning generated.

10. The hearing aid device according to claim 6, wherein the notification synthesizer generates a warning when the notification synthesizer receives a notification from the notification controller.

* * * * *